US009541890B2

(12) United States Patent
Kobayashi

(10) Patent No.: US 9,541,890 B2
(45) Date of Patent: Jan. 10, 2017

(54) IMAGE FORMING APPARATUS

(71) Applicant: KYOCERA Document Solutions Inc., Osaka (JP)

(72) Inventor: Kimihiko Kobayashi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/053,083

(22) Filed: Feb. 25, 2016

(65) Prior Publication Data

US 2016/0252872 A1 Sep. 1, 2016

(30) Foreign Application Priority Data

Feb. 26, 2015 (JP) ..... 2015-037400

(51) Int. Cl.

*G03G 21/12* (2006.01)
*G03G 21/10* (2006.01)
*G03G 15/08* (2006.01)

(52) U.S. Cl.

CPC ..... *G03G 21/10* (2013.01); *G03G 15/0862* (2013.01); *G03G 21/105* (2013.01); *G03G 21/12* (2013.01); *G03G 2215/0891* (2013.01); *G03G 2215/0894* (2013.01)

(58) Field of Classification Search

CPC ..... G03G 21/10; G03G 21/105; G03G 21/12; G03G 15/0862; G03G 2215/0891; G03G 2215/0894

USPC ..... 399/35

See application file for complete search history.

(56) References Cited

U.S. PATENT DOCUMENTS 4,688,924 A * 8/1987 Anzai ..... B65H 33/08 271/288
5,412,457 A * 5/1995 Kawano ..... G03G 15/0896 399/228
9,158,268 B2 * 10/2015 Sayama ..... G03G 21/12
2010/0209141 A1 * 8/2010 Ikado ..... G03G 15/0872 399/119

FOREIGN PATENT DOCUMENTS

JP 2002-287595 A 10/2002
JP 2002287595 A * 10/2002
JP 2010152252 A * 7/2010

* cited by examiner

*Primary Examiner* — David Gray
*Assistant Examiner* — Tyler Hardman
(74) *Attorney, Agent, or Firm* — IP Business Solutions, LLC

(57) ABSTRACT

An optical sensor has a light emission section and a light reception section so arranged as to sandwich an opening part of a toner container from both sides when the toner container is attached, and a shutter slides in conjunction with the attachment and detachment of the toner container and has a top surface member opening and closing a toner exhaust port of a cleaning device and a side surface member transmitting and blocking light of the optical sensor. A slit orthogonal to a sliding direction of the shutter is formed at the side surface member of the shutter, and the control section performs detection of attachment and detachment of the toner container based on a waveform pattern of light transmitted through the slits which pattern appears in a signal of the optical sensor.

5 Claims, 10 Drawing Sheets

IMAGE FORMING APPARATUS

INCORPORATION BY REFERENCE

This application claims priority to Japanese Patent Application No. 2015-037400 filed on Feb. 26, 2015, the entire contents of which are incorporated by reference herein.

BACKGROUND

This disclosure relates to an image forming apparatus, and more specifically to a technology of detecting attachment and detachment of a toner container.

An image forming apparatus having a mechanism of collecting, in a toner container, a toner adhering to a drum surface is provided with means for detecting that the toner container is full of the toner. As a method of detecting this toner container fullness, there is a method of arranging a light emission section and a light reception section in a manner such as to sandwich an opening part of the toner container from both sides and judging the fullness as a result of detection that light emitted from the light emission section is blocked by the toner accumulated in the toner container and the light no longer enters the light reception section.

The fullness detection using such an optical sensor is easily influenced by a form in which the toner is accumulated in the toner container, and in case of deformation of the accumulation form due to, for example, oscillation, the blocked light may be transmitted again in some cases. Thus, even when the transmitted light is received again by the light reception section after the fullness detection, control of maintaining the fullness detection is performed. However, upon replacement of the toner container, this fullness detection needs to be reset, and thus the fullness detection using such an optical sensor requires a trigger for releasing the detection of the toner fullness of the toner container.

As this trigger, cover opening and closing detection at a portion storing the toner container is used in many cases. For example, disclosed is a technology of omitting a mechanism of the cover opening and closing detection for, for example, cost reduction, in place of this mechanism, using a mechanism of detecting toner fullness of a toner container to detect attachment and detachment of the toner container and using it as the trigger for releasing the detection of the toner fullness of the toner container.

SUMMARY

As one aspect of this disclosure, a technology obtained by further improving the technology described above is suggested.

An image forming apparatus according to one aspect of this disclosure includes: an image carrier, a transfer device, a cleaning device, a toner container, an optical sensor, a shutter, and a control section.

The image carrier has a surface on which a toner image is developed.

The transfer device transfers the toner image from the image carrier onto paper.

The cleaning device removes a toner remaining on the surface of the image carrier and discharges the toner from a toner exhaust port.

The toner container is of a detachable type having an opening part formed of a transparent member, receiving, through the opening part, the toner discharged from the cleaning device, and storing the toner therein.

The optical sensor has a light emission section and a light reception section arranged at position sandwiching the opening part of the toner container from both sides when the toner container is attached.

The shutter slides in conjunction with the attachment and detachment of the toner container, and has a top surface member opening and closing the toner exhaust port of the cleaning device and a side surface member transmitting and blocking light of the optical sensor.

The control section, based on a signal outputted from the optical sensor, performs detection of fullness of the toner stored in the toner container and detection of the attachment and detachment of the toner container, A slit extending in a direction orthogonal to a sliding direction of the shutter is formed at the side surface member of the shutter.

The control section performs the detection of the attachment and detachment of the toner container based on a waveform pattern of light transmitted through the slits which pattern appears in the signal of the optical sensor.

DETAILED DESCRIPTION

Figure 1:
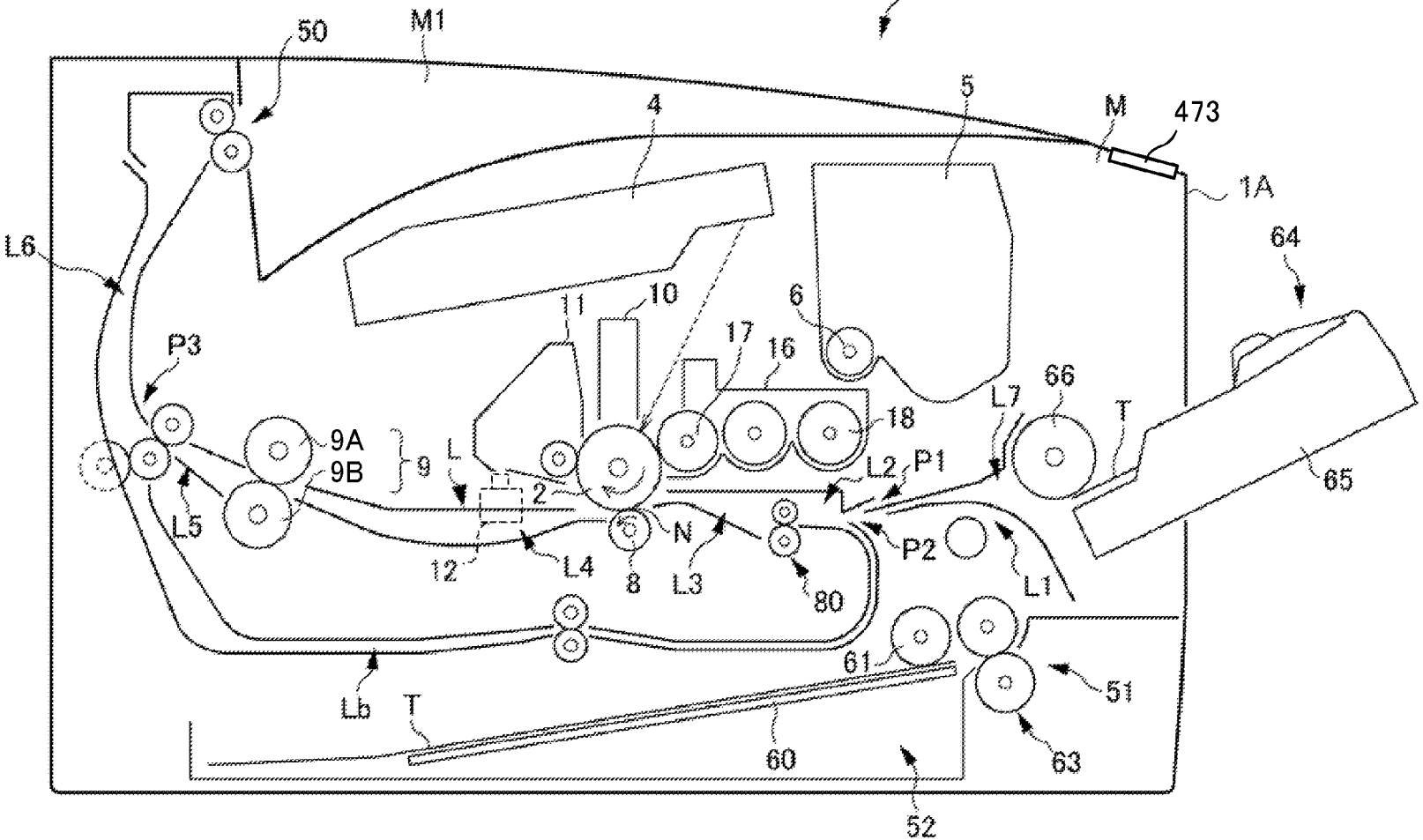
FIG. 1 is a left side sectional view showing a structure of an image forming apparatus according to one embodiment of this disclosure.

Hereinafter, an image forming apparatus according to one embodiment of this disclosure will be described with reference to the drawings. FIG. 1 is a left side sectional view showing a structure of the image forming apparatus according to one embodiment of this disclosure.

The image forming apparatus 1 according to one embodiment of this disclosure is, for example, a printer. In this embodiment, a side on which a manual feed tray 65 to be described later is arranged (a right side in FIG. 1) is defined as a front side of the image forming apparatus 1.

As shown in FIG. 1, an image formation section includes: a photoconductive drum 2, a charging section 10, a laser scanner unit 4, a developing device 16, a toner cartridge 5, a toner supply device 6, a transfer roller 8, a fixing device 9, and a drum cleaning section 11. A paper feed and discharge section includes: a paper feed cassette 52, the manual feed tray 65, a registration roller pair 80, and a conveyance path L for paper T.

The photoconductive drum 2 is formed of a cylindrically-shaped member, and functions as an image carrier. The photoconductive drum 2 is arranged in a housing M in such a manner as to be rotatable around a rotation axis perpendicular to FIG. 1. On a surface of the photoconductive drum 2, an electrostatic latent image is formed.

The charging section 10 is arranged above the photoconductive drum 2. The charging section 10 positively charges the surface of the photoconductive drum 2 (to a plus polarity) in a uniform manner.

The laser scanner unit 4, based on image information outputted from an external device such as a personal computer (PC), scans and exposes the surface of the photoconductive drum 2. Through the scanning and exposure performed by the laser scanner unit 4, charges around the surface of the photoconductive drum 2 are removed. As a result, an electrostatic latent image is formed on the surface of the photoconductive drum 2.

The developing device 16 is arranged in front of the photoconductive drum 2 (on a right side thereof in FIG. 1). The developing device 16 develops a monochromatic (normally black) toner image on the electrostatic latent image formed on the photoconductive drum 2. The developing device 16 has: a developing roller 17 which can be arranged oppositely to the photoconductive drum 2; and a stirring spiral 18 for toner stirring.

The toner cartridge 5 stores a toner supplied to the developing device 16. The toner supply device 6 supplies, to the developing device 16, the toner stored in the toner cartridge 5.

The drum cleaning section 11 is arranged behind the photoconductive drum 2 (on a left side thereof in FIG. 1), and functions as a cleaning device. The drum cleaning section 11 removes the toner and an adhesive substance remaining on the surface of the photoconductive drum 2, and also discharges the removed toner, etc. (waste toner) to a toner container 12.

The transfer roller 8 functions as a transfer device which transfers, onto the paper T, the toner image developed on the surface of the photoconductive drum 2. Applied to the transfer roller 8 by voltage application means (not shown) is a transfer bias for transferring, onto the paper T, the toner image developed on the photoconductive drum 2.

The paper T is sandwiched between the photoconductive drum 2 and the transfer roller 8, and is pushed against the surface of the photoconductive drum 2 (on a side on which the toner image has been developed). In this manner, a transfer nip N is formed, and the toner image developed on the photoconductive drum 2 is transferred onto the paper T.

The fixing device 9 melts the toner forming the toner image transferred onto the paper T, and fixes it on the paper T. The fixing device 9 includes: a heat roller 9A and a pressure roller 9B in contact with the heat roller 9A.

In the paper feed cassette 52 of the cassette paper feed section 51, the paper T is stored in a manner such as to be superposed on a loading plate 60. The cassette paper feed section 51 includes a document stop mechanism composed of: a forward feed roller 61 removing the paper T loaded on the loading plate 60; and a roller pair 63 individually feeding out the paper T to the conveyance path L.

Formed between the cassette paper feed section 51 or a manual paper feed section 64 and a paper discharge section 50 is the conveyance path L through which the paper T is conveyed. The conveyance path L includes: a first conveyance path L1 from the cassette paper feed section 51 to a first merging part P1; a second conveyance path L2 from the first merging part P1 to the registration roller pair 80; a third conveyance path L3 from the registration roller pair 80 to the transfer roller 8; a fourth conveyance path L4 from the transfer roller 8 to the fixing device 9; a fifth conveyance path L5 from the fixing device 9 to a bifurcation part P3; a sixth conveyance path L6 from the bifurcation part P3 to the paper discharge section 50; and a seventh conveyance path L7 from the manual feed tray 65 to the first merging part P1.

The first merging part P1 is a merging part for the first conveyance path L1 through which the paper T is conveyed from the cassette paper feed section 51 and the seventh conveyance path L7 through which the paper T is conveyed from the manual feed tray 65.

Arranged on the way of the second conveyance path L2 is a second merging part P2. The conveyance path L further has a return conveyance path Lb from the bifurcation part P3 to the second merging part P2. The second merging part P2 is a merging part for the second conveyance path L2 and the return conveyance path Lb.

Arranged on an upstream side (a right side in FIG. 1) of the transfer roller 8 in a direction in which the paper T is conveyed is the registration roller pair 80.

The return conveyance path Lb is a conveyance path provided for placing a surface, which is opposite to an already printed surface, oppositely to the photoconductive drum 2 upon duplex printing on the paper T.

The manual paper feed section 64 on a front side (a right side in FIG. 1) of the housing M includes: the manual feed tray 65 as a paper loading section, and a paper feed roller 66.

Formed on an opening side of the paper discharge section 50 is a discharged paper accumulation section M1. On the discharged paper accumulation section M1, pieces of paper T which have been discharged from the paper discharge section 50 and on which a predetermined image has been transferred are accumulated in a manner such as to be superposed one on top of another.

Figure 2:
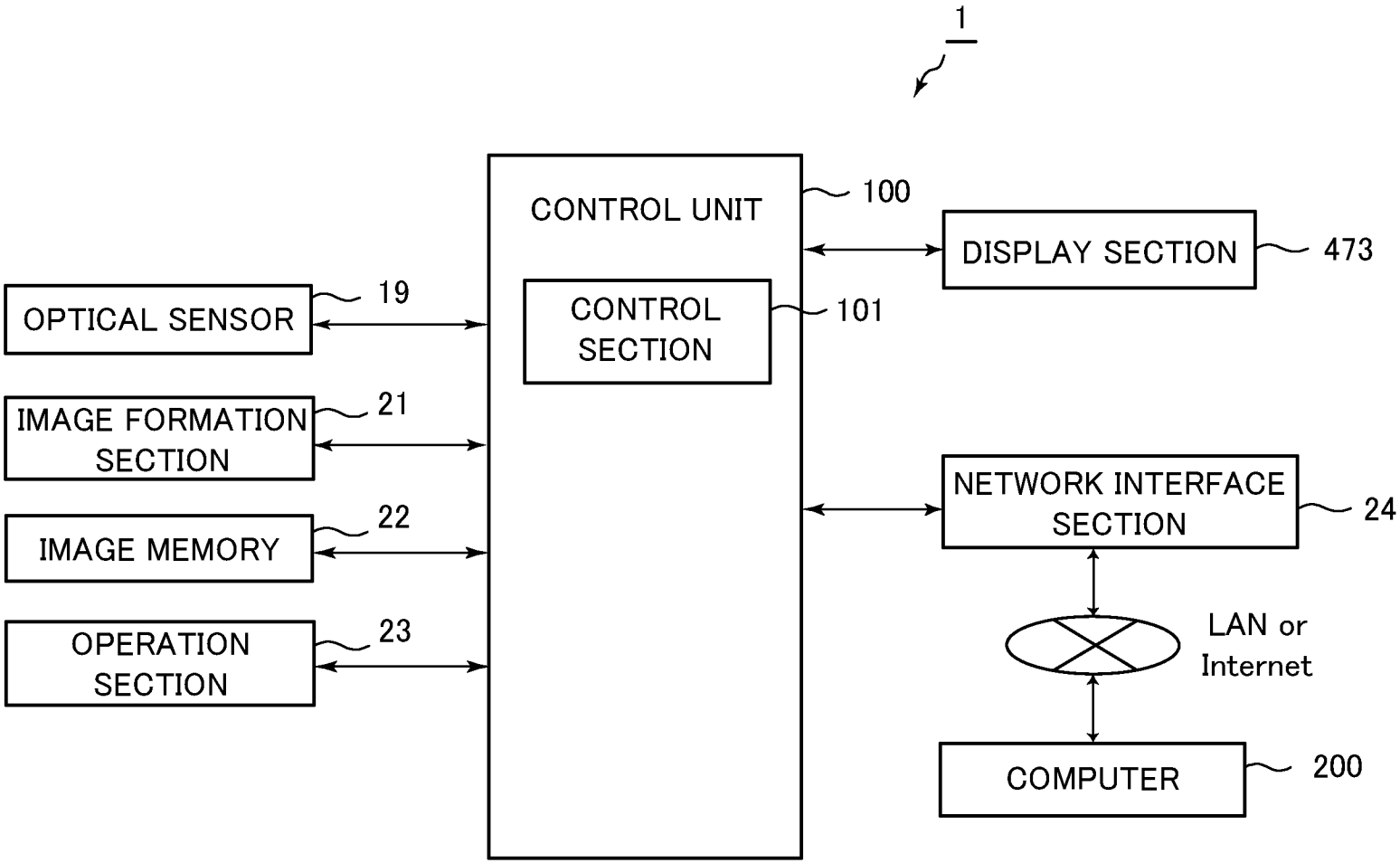
FIG. 2 is a functional block diagram schematically showing main inner configuration of the image forming apparatus.

Next, hardware configuration of the image forming apparatus 1 will be described. FIG. 2 is a functional block diagram showing main inner configuration of the image forming apparatus 1.

The image forming apparatus 1 includes: a control unit 100, an optical sensor 19, an image formation section 21, an image memory 22, an operation section 23, a network interface section 24, etc.

The optical sensor 19 is a sensor provided for detecting toner fullness of the toner container 12, as described below.

The image formation section 21 performs image formation on, for example, print data received from a network-connected computer 200.

The image memory 22 is a region where data to be printed in the image formation section 21 is temporarily saved.

The operation section 23 receives instructions from an operator for various operations and processing executable by the image forming apparatus 1.

The network interface section 24 is formed of a communication module such as a LAN board, and performs transmission and reception of various pieces of data to and from, for example, the computer 200 in a local area via, for example, the LAN connected to the network interface section 24.

The control unit 100 is composed of a central processing unit (CPU), a RAM, a ROM, a dedicated hardware circuit, etc., and is in charge of overall operation control of the image forming apparatus 1. The control unit 100 includes a control section 101.

The control section 101 is connected to: the optical sensor 19, the image formation section 21, the image memory 22, the operation section 23, the network interface section 24, etc., and performs driving control of these sections, paper conveyance control, and image formation control.

In particular, the control section 101, based on a signal of the optical sensor 19, performs detection of the toner fullness of the toner container 12 and detection of attachment and detachment of the toner container 12.

Figure 3:
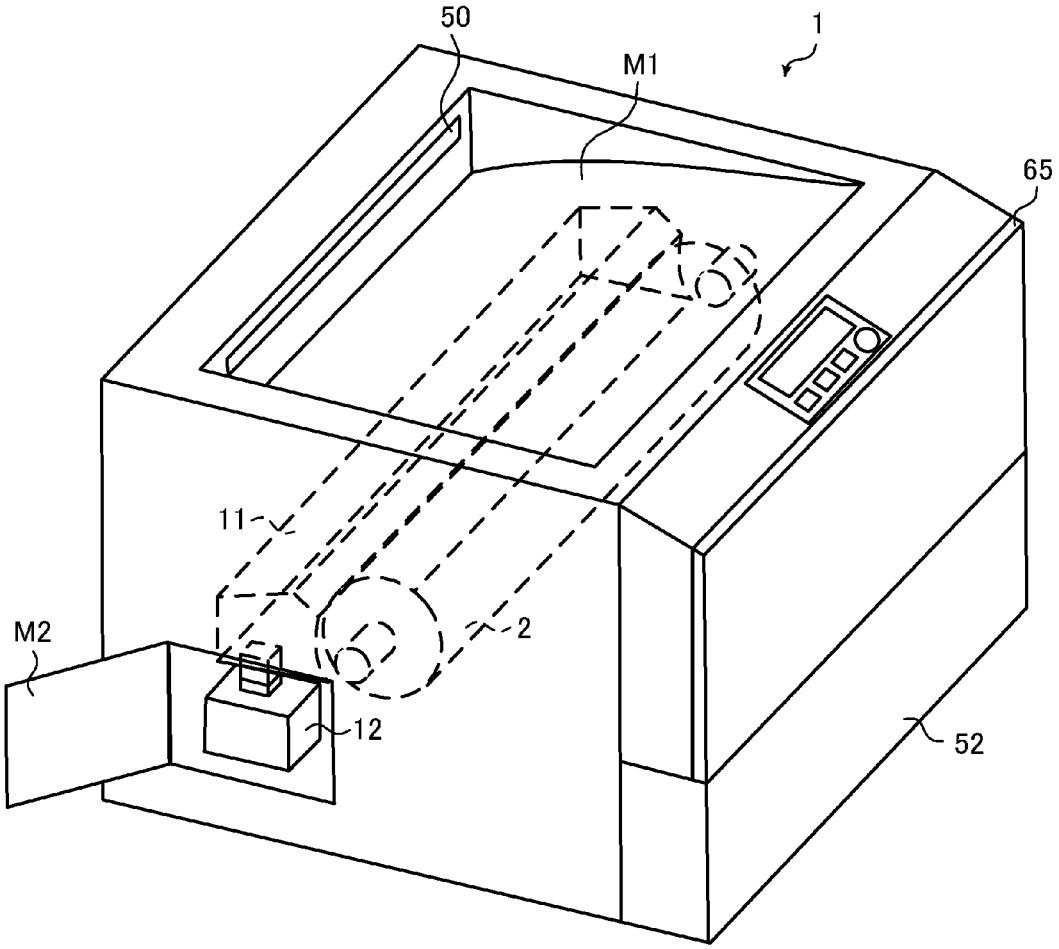
FIG. 3 is a perspective view of the image forming apparatus at an oblique angle from top left.

Next, toner collection in the image forming apparatus 1 will be described. FIG. 3 is a perspective view of the image forming apparatus 1 at an oblique angle from top left.

Provided on a left side surface of the housing M in the image forming apparatus 1 is a side cover M2 of an openable and closable type. The toner container 12 is attached below the drum cleaning section 11, and collects a toner discharged from the drum cleaning section 11. The toner container 12 can be removed from the apparatus or attached into the apparatus by opening the side cover M2.

Figure 4A:
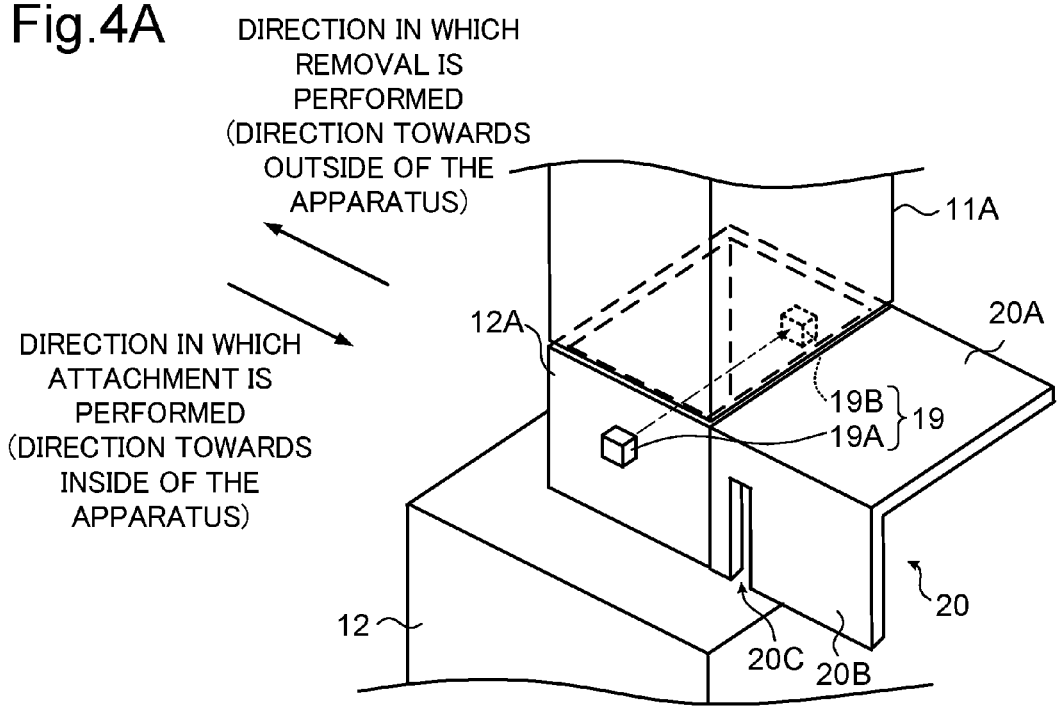
FIGS. 4A and 4B are enlarged perspective views showing a mechanism around an opening part of a toner container and a toner exhaust port.
Figure 4B:
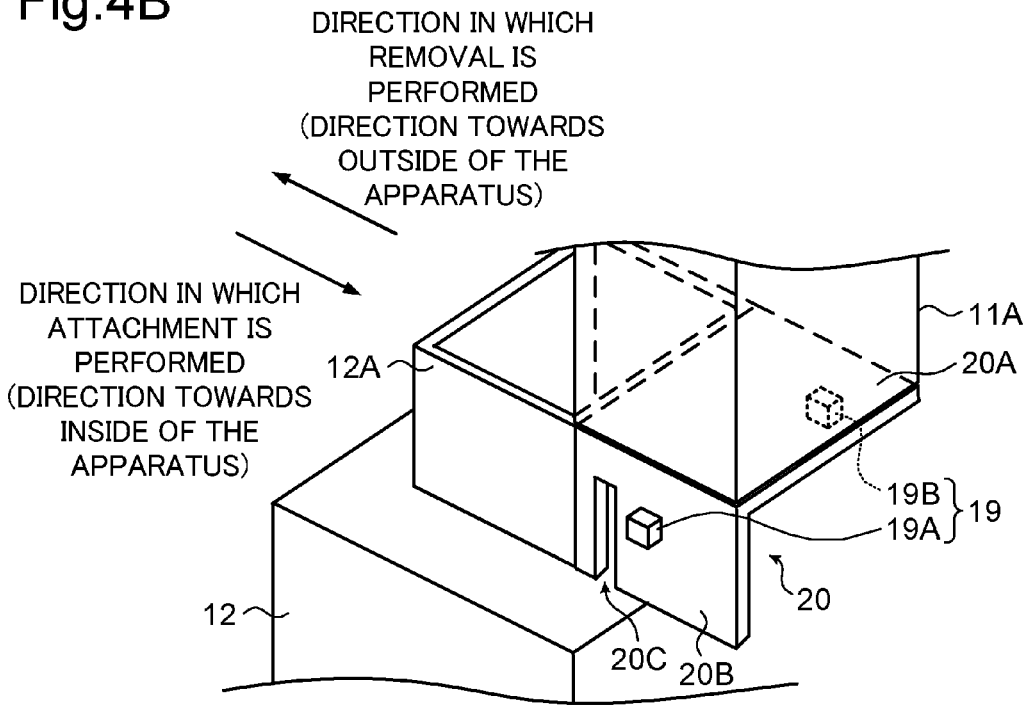

FIGS. 4A and 4B are enlarged perspective views showing a mechanism around an opening part of the toner container 12 and a toner discharge port. The drum cleaning section 11 has a toner discharge port 11A which extends vertically for discharging the toner to an outside. On the other hand, the toner container 12 has, at a top thereof, an opening part 12A for receiving the toner.

In a case where the toner container 12 is attached, as shown in FIG. 4A, the toner exhaust port 11A of the drum cleaning section 11 and the opening part 12A of the toner container 12 vertically overlap each other, and thus the toner container 12 can receive the toner discharged from the toner exhaust port 11A of the drum cleaning section 11 and store it therein.

The optical sensor 19 for detecting the toner fullness of the toner container 12 is provided below the toner exhaust port 11A. This optical sensor 19 is attached to, for example, an apparatus body 1A (FIG. 1) of the image forming apparatus 1. The optical sensor 19 has a light emission section 19A and a light reception section 19B. The light emission section 19A and the light reception section 19B are arranged below the toner exhaust port 11A. The light emission section 19A and the light reception section 19B are so arranged as to be fixed at a position sandwiching the opening part 12A of the toner container 12 from both sides when the opening part 12A is located below the toner exhaust port 11A as a result of attachment of the toner container 12 (FIG. 4A).

The opening part 12A, at least a portion thereof sandwiched between the light emission section 19A and the light reception section 19B of the optical sensor 19 is formed of a light transmissive material, for example, a transparent material (Transparent member). Light outputted from the light emission section 19A enters the light reception section 19B through the opening part 12A. At this point, if the light emitted from the light emission section 19A has not yet reached a point on an optical path directed towards the light reception section 19B, the light outputted from the light emission section 19A is not blocked by the toner stored in the toner container 12 and enters the light reception section 19B without being attenuated. If the toner has reached the aforementioned point on the optical path, the toner stored in the toner container 12 is judged to be in a full state. On the other hand, in a case where the toner in the toner container 12 is in such a full state that it is accumulated up to the opening part 12A, the light outputted from the light emission section 19A is attenuated by the accumulated toner before entering the light reception section 19B. If the light reception section 19B has received the light emitted from the light emission section 19A described above, the control section 101 detects that the toner has not yet reached the point on the optical path and is not in a full state, and if the light reception section 19B has not received the light emitted from the light emission section 19A, the control section 101 detects that the toner has reached the point on the optical path and is in a full state.

A shutter 20 is biased by a spring or the like, not shown, in a direction in which the toner container 12 is removed. As a result, in a case where the toner container 12 is removed, the shutter 20 moves to a place immediately below the toner exhaust port 11A, and the toner exhaust port 11A is closed by a top surface member 20A of the shutter 20 (FIG. 4B).

For example, in a case where the toner container 12 arranged at a predefined position of the apparatus body 1A has been removed from this arrangement position and then has moved and detached from the position below the toner exhaust port 11A of the drum cleaning section 11, there is a risk that the toner leaks from the toner exhaust port 11A into the apparatus. Thus, the shutter 20 is provided, so that in a case where the toner container 12 is removed, as shown in FIG. 4B, the shutter 20 closes the toner exhaust port 11A, thereby avoiding the toner leak into the apparatus.

On the other hand, upon attachment of the toner container 12, the opening part 12A of the toner container 12 makes contact with the shutter 20, which is pushed in a direction in which the toner container 12 is attached. In this manner, in conjunction with the attachment and detachment of the toner container 12, the shutter 20 slides in directions in which the toner container 12 is removed and attached.

The shutter 20 has a side surface member 20B. Thus, upon removal of the toner container 12 (FIG. 4B), the side surface member 20B of the shutter 20 moves to a place immediately below the toner exhaust port 11A, blocking the light of the optical sensor 19.

On the other hand, in a case where the toner container 12 is attached (FIG. 4A), the shutter 20 is pushed further inside whereby the side surface member 20B of the shutter 20 deviates from a ray axis of the light emission section 19A and the light reception section 19B of the optical sensor 19, and the light of the light emission section 19A is transmitted through the opening part 12A of the toner container 12 and reaches the light reception section 19B. The control section 101, based on whether or not to receive a signal outputted in accordance with this light reception by such a light reception section 19B, detects the attachment or detachment of the toner container 12.

Note that the signal of the optical sensor 19 is also blocked in a state in which the toner of the toner container 12 is full, and thus in the image forming apparatus 1 according to this embodiment, a slit 20C orthogonal to a sliding direction of the shutter 20 is provided at the side surface member 20B of the shutter 20 to thereby permit discrimination from the toner full state. The slit 20C is formed at a position eccentric from a central part towards a widthwise end part across a width of the side surface member 20B in the direction in which the toner container 12 is removed. In this embodiment, the slit 20C is formed at a position of the side surface member 20B which is eccentric towards the direction in which the toner container 12 is detached.

Figure 5:
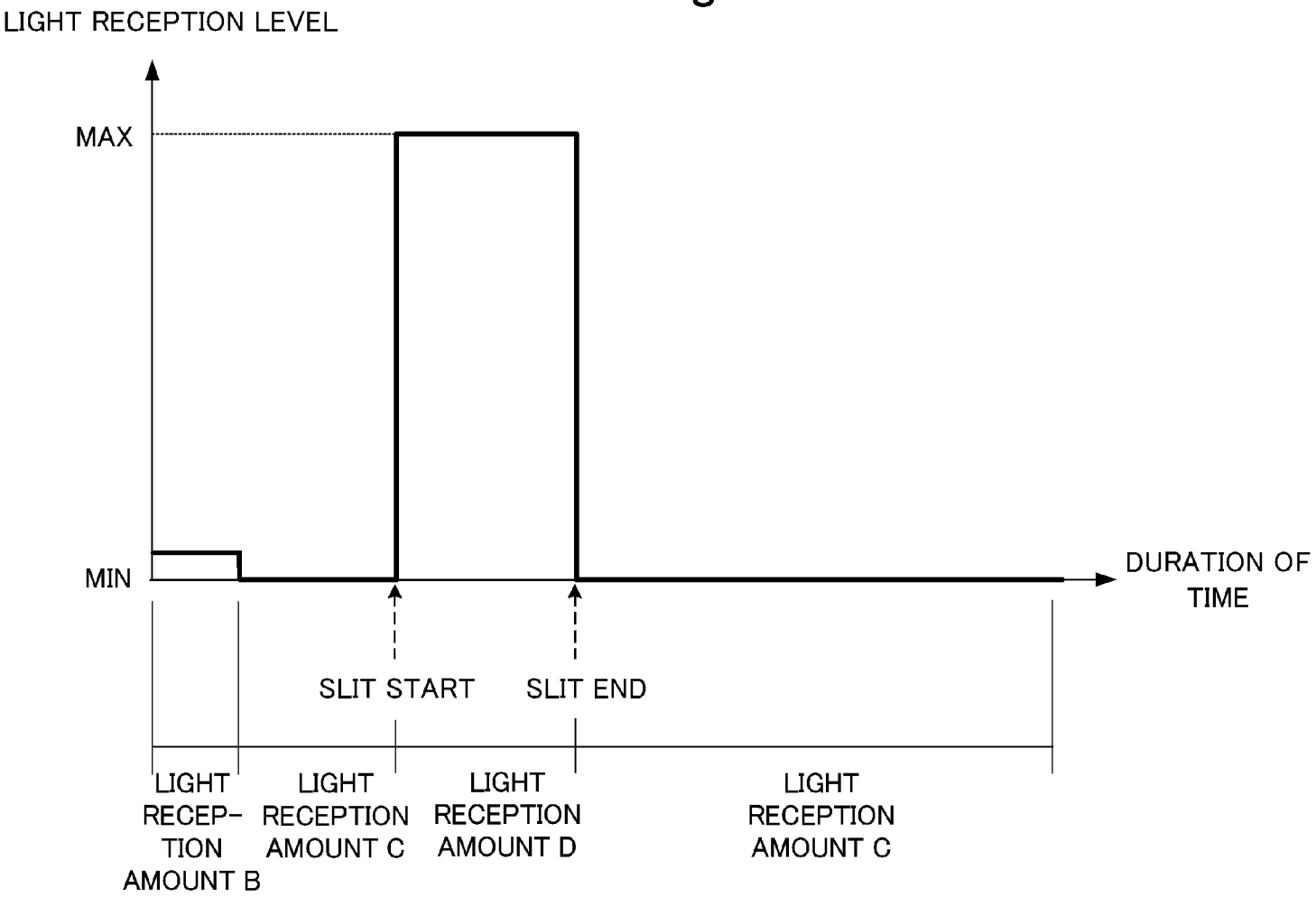
FIG. 5 is a waveform diagram of an optical sensor signal upon removal of the toner container.

FIG. 5 is a waveform diagram of a signal of the optical sensor 19 upon the removal of the toner container 12. Upon the removal of the toner container 12, the shutter 20 slides in the direction in which the toner container 12 is removed. At this point, assuming that a light reception level of the optical sensor 19 is, for example, a minimum value while the light of the optical sensor 19 is blocked by the side surface member 20B of the shutter 20, reach of the ray axis of the optical sensor 19 at the slit 20C results in no obstacle which blocks the light of the optical sensor 19, and the light of the optical sensor 19 is transmitted whereby the light reception level of the optical sensor 19 becomes a maximum value. Then if the slit 20C has passed and the light of the optical sensor 19 has been blocked again by the side surface member 20B of the shutter 20, the light reception level of the optical sensor 19 becomes a minimum value.

Figure 6:
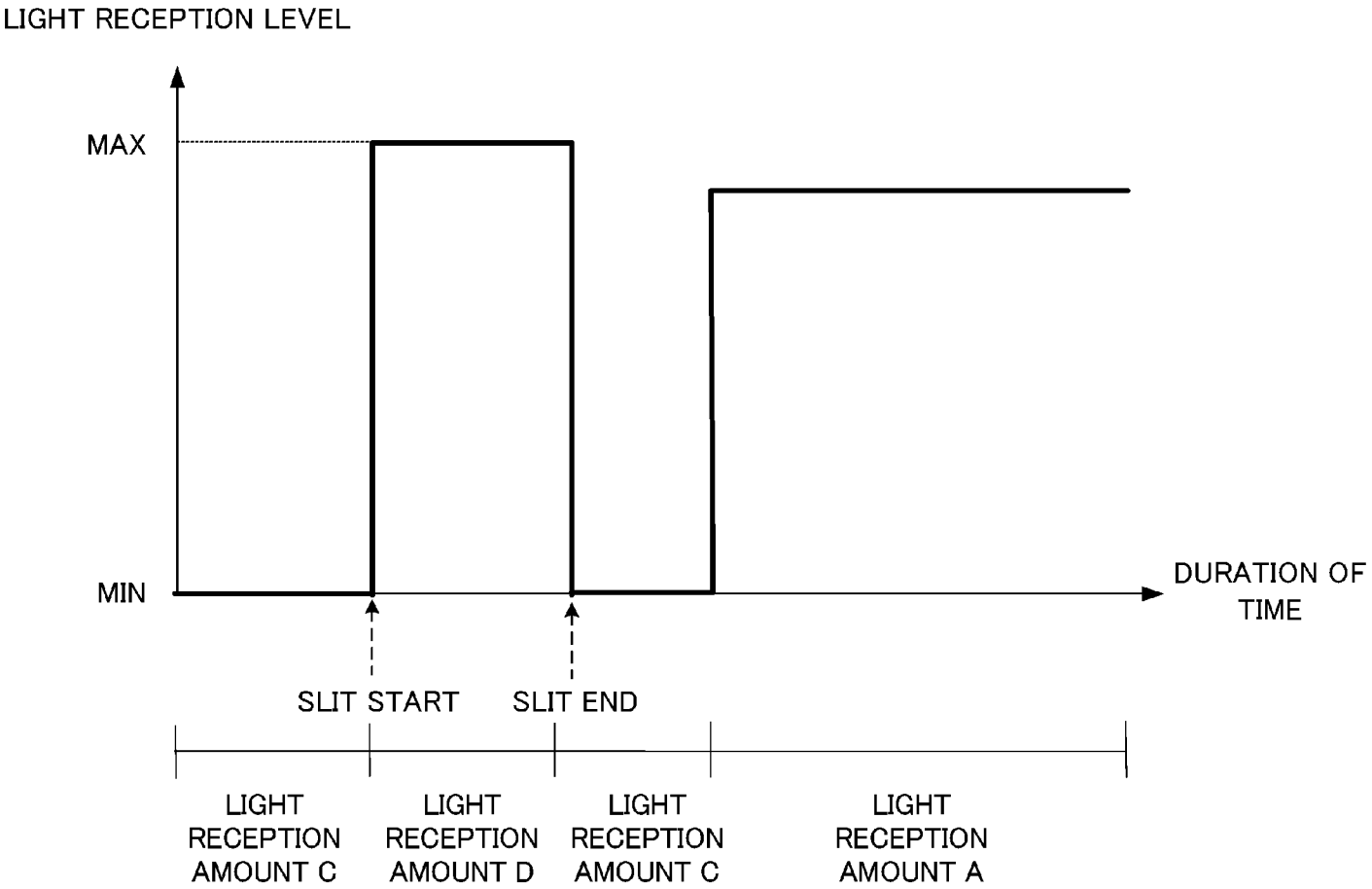
FIG. 6 is a waveform diagram of an optical sensor signal upon attachment of the toner container.

FIG. 6 is a waveform diagram of a signal of the optical sensor 19 upon the attachment of the toner container 12. Upon the attachment of the toner container 12, the shutter 20 slides in the direction in which the toner container 12 is attached. At this point, the light reception level of the optical sensor 19 is a minimum value while the light of the optical sensor 19 is blocked by the side surface member 20B of the shutter 20, but reach of the ray axis of the optical sensor 19 at the slit 20C results in no obstacle which blocks the light of the optical sensor 19, and the light of the optical sensor 19 is transmitted whereby the light reception level of the optical sensor 19 becomes a maximum value. At this point, the slit 20C is formed at a position of the side surface member 20B which is eccentric towards the direction in which the toner container 12 is detached, and thus assuming that the toner container 12 has moved at a fixed speed in the direction in which the toner container 12 is attached, compared to when the toner container 12 is removed, a waveform indicating that the light reception level of the optical sensor 19 becomes a maximum value is generated more slowly from a time point at which the toner container 12 starts to move. Then if the slit 20C has passed and the light of the optical sensor 19 has been blocked again by the side surface member 20B of the shutter 20, the light reception level of the optical sensor 19 becomes a minimum value.

At the light reception section 19B, differences arise between: a light reception amount A of light received by the light reception section 19B from the light emission section 19A through the opening part 12A in a state in which no toner is inside the opening part 12A; a light reception amount B of light received by the light reception section 19B through the opening part 12A in a state in which the optical path is interfered or nearly blocked by the toner in the opening part 12A; a light reception amount C of light received by the light reception section 19B in a state in which the optical path is blocked by the side surface member 20B of the shutter 20; and a light reception amount D of light received by the light reception section 19B directly from the light emission section 19A through the slit 20C without transmitted through the opening part 12A.

Thus, upon appearance of a waveform pattern as shown in FIG. 5, for example, based on a duration of time between a time point at which a change occurs from the light reception amount B to the light reception amount C and appearance of a maximum value of the light reception level (the light reception amount D), the control section 101 can detect that the toner container 12 has been removed. Moreover, upon appearance of a waveform pattern as shown in FIG. 6, based on a duration of time between end of the maximum value of the light reception level (the light reception amount D) and occurrence of a change to the light reception mount A, the control section 101 can detect that the toner container 12 has been fitted. As a result, by using the optical sensor 19 for detecting the toner fullness of the toner container 12, the attachment and detachment of the toner container 12 can be detected without increasing a threshold value for detecting the toner fullness of the toner container 12.

Specifically, there are no longer needs of providing a difference between a light reception level of the optical sensor 19 for releasing the toner fullness detection and a light reception level of the optical sensor 19 indicating the detection of the toner fullness of the toner container 12, which therefore also makes it possible to, for example, based on these light reception levels, equalize the threshold value for detecting the toner fullness and a threshold value for detecting the blockage of the optical path by the side surface member 20B of the shutter 20. As a result, the threshold value used for detecting the toner fullness of the toner container 12 can be set at an even lower value. Thus, an amount of toner stored in the toner container 12 can be increased, which can improve a working ratio of the image forming apparatus 1.

Figure 7A:
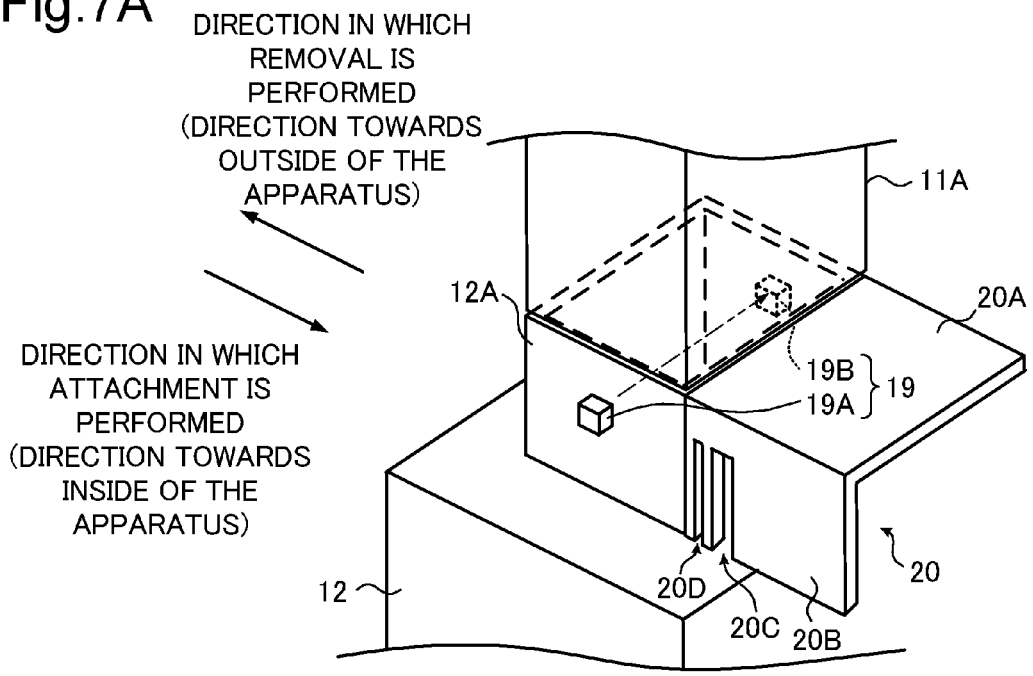
FIGS. 7A and 7B are enlarged perspective views showing another example of the mechanism around the opening part of the toner container and the toner exhaust port.
Figure 7B:
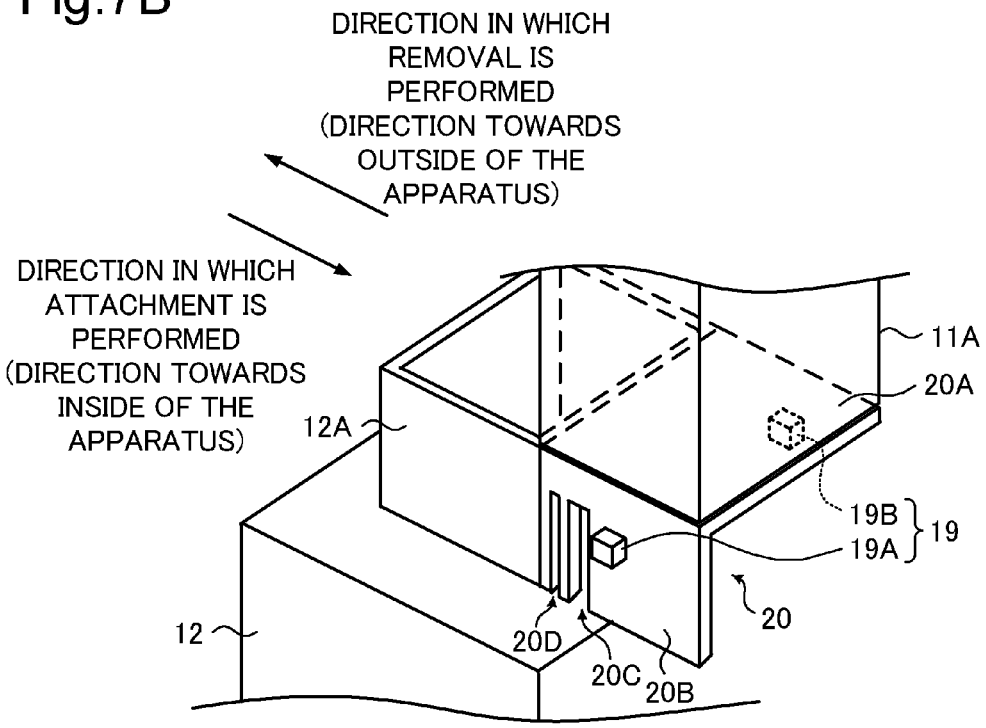

FIGS. 7A and 7B are enlarged perspective views showing another example of the mechanism around the opening part of the toner container 12 and the toner exhaust port. With configuration shown in FIGS. 7A and 7B, which is different from the configuration shown in FIGS. 4A and 4B, a wide slit 20C and a narrow slit 20D are formed alongside at the side surface member 20B of the shutter 20.

Figure 8:
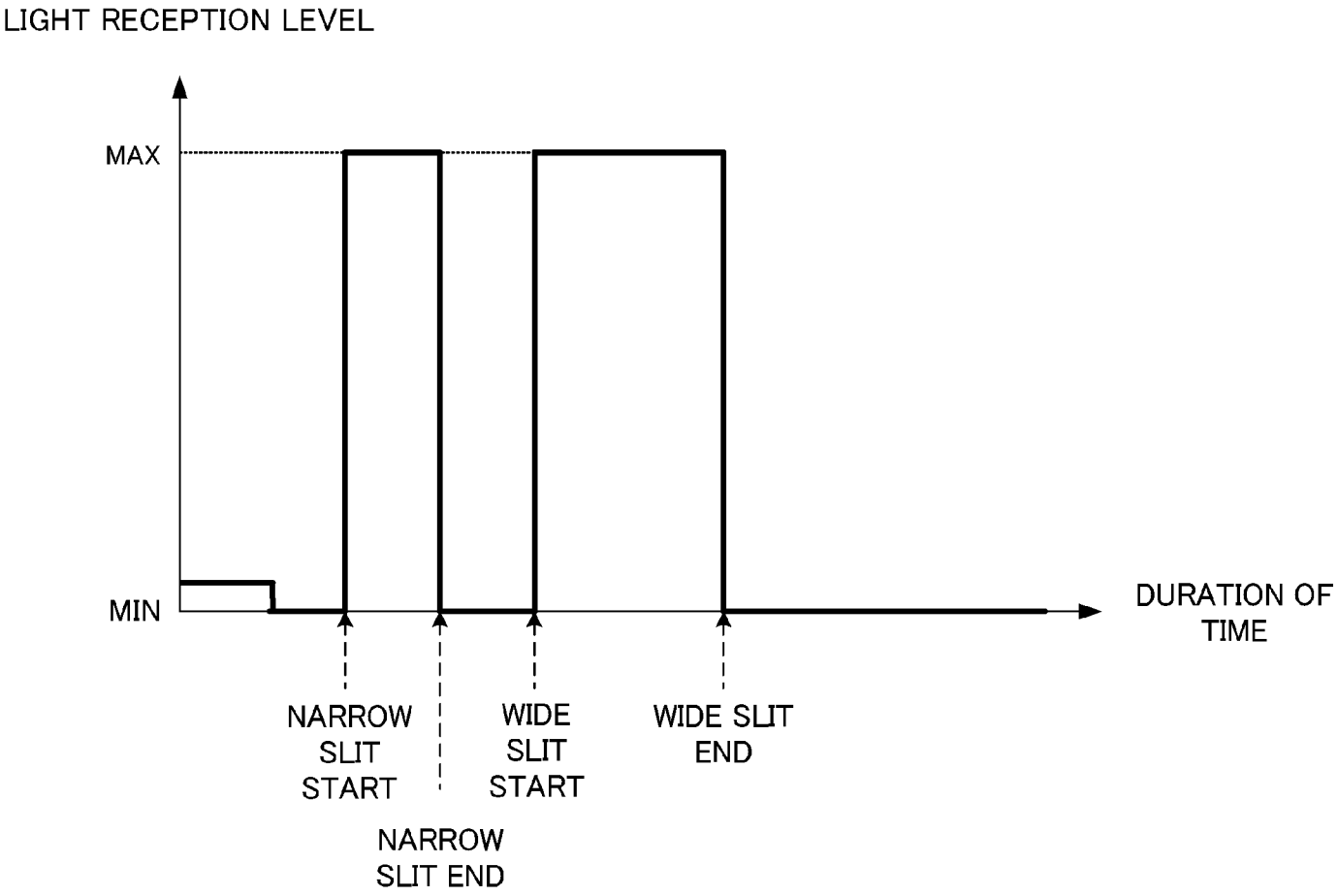
FIG. 8 is a waveform diagram of an optical sensor signal upon removal of the toner container in another example.

FIG. 8 is a waveform diagram of a signal of the optical sensor 19 upon removal of the toner container 12 in another example. Upon the removal of the toner container 12, the shutter 20 slides in a direction in which the toner container 12 is removed. At this point, assuming that a light reception level of the optical sensor 19 is, for example, a minimum value while the light of the optical sensor 19 is blocked by the side surface member 20B of the shutter 20, the ray axis of the optical sensor 19 first reaches the narrow slit 20D, and the light reception level of the optical sensor 19 becomes a maximum value. Then if the narrow slit 20D has passed and the light of the optical sensor 19 has been blocked again by the side surface member 20B of the shutter 20, the light reception level of the optical sensor 19 becomes a minimum value. Next, the ray axis of the optical sensor 19 reaches the wide slit 20C, and the light reception level of the optical sensor 19 becomes a maximum value again. Then if the wide slit 20C has passed and the light of the optical sensor 19 has been blocked again by the side surface member 20B of the shutter 20, the light reception level of the optical sensor 19 becomes a minimum value again.

Figure 9:
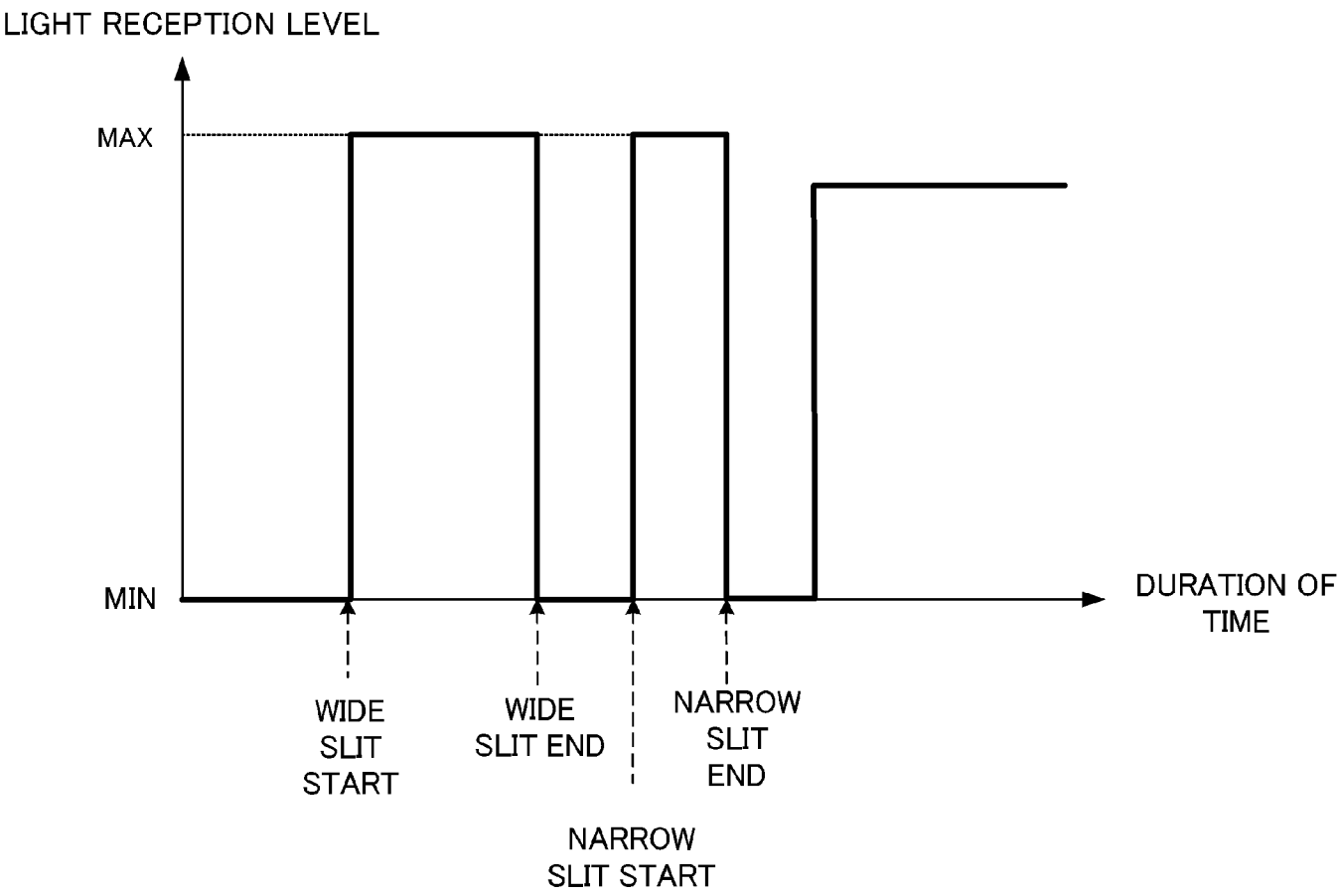
FIG. 9 is a waveform diagram of an optical sensor signal upon attachment of the toner container in another example.

FIG. 9 is a waveform diagram of a signal of the optical sensor 19 upon attachment of the toner container 12 in another example. Upon the attachment of the toner container 12, the shutter 20 slides in a direction in which the toner container 12 is attached. At this point, the light reception level of the optical sensor 19 is a minimum value while the light of the optical sensor 19 is blocked by the side surface member 20B of the shutter 20, but the ray axis of the optical sensor 19 first reaches the wide slit 20C, and the light reception level of the optical sensor 19 becomes a maximum value. Then if the wide slit 20C has passed and the light of the optical sensor 19 has been blocked again by the side surface member 20B of the shutter 20, the light reception level of the optical sensor 19 becomes a minimum value. Next, the ray axis of the optical sensor 19 reaches the narrow slit 20D, and the light reception level of the optical sensor 19 becomes a maximum value again. Then if the narrow slit 20D has passed and the light of the optical sensor 19 has been blocked again by the side surface member 20B of the shutter 20, the light reception level of the optical sensor 19 becomes a minimum value again.

Upon appearance, in the signal of the optical sensor 19, of a waveform pattern as shown in FIG. 8, that is, a waveform pattern with a waveform generated based on reception of the light first passing in correspondence with the narrow slit 20D in a state in which the toner container 12 is attached, the control section 101 can detect that the toner container 12 has been removed. On the other hand, upon appearance, in the signal of the optical sensor 19, of a waveform pattern as shown in FIG. 9, that is, a waveform pattern with a waveform generated based on reception of the light first passing in correspondence with the wide slit 20C in a state in which the toner container 12 is removed, the control section 101 can detect that the toner container 12 has been attached. As a result, by using the optical sensor 19 for detecting the toner fullness of the toner container 12, the attachment and detachment of the toner container 12 can be detected without increasing the threshold value for detecting the toner fullness of the toner container 12.

In another example of FIGS. 7A and 7B in particular, as a result of providing the side surface member 20B of the shutter 20 with the slit 20C and the slit 20D having mutually different widths, between when the toner container 12 is attached and when the toner container 12 is removed, the different waveform patterns appear in the signal of the optical sensor 19, thus making it possible to properly identify the sliding direction of the shutter 20, that is, the attachment or detachment of the toner container 12.

Figure 10:
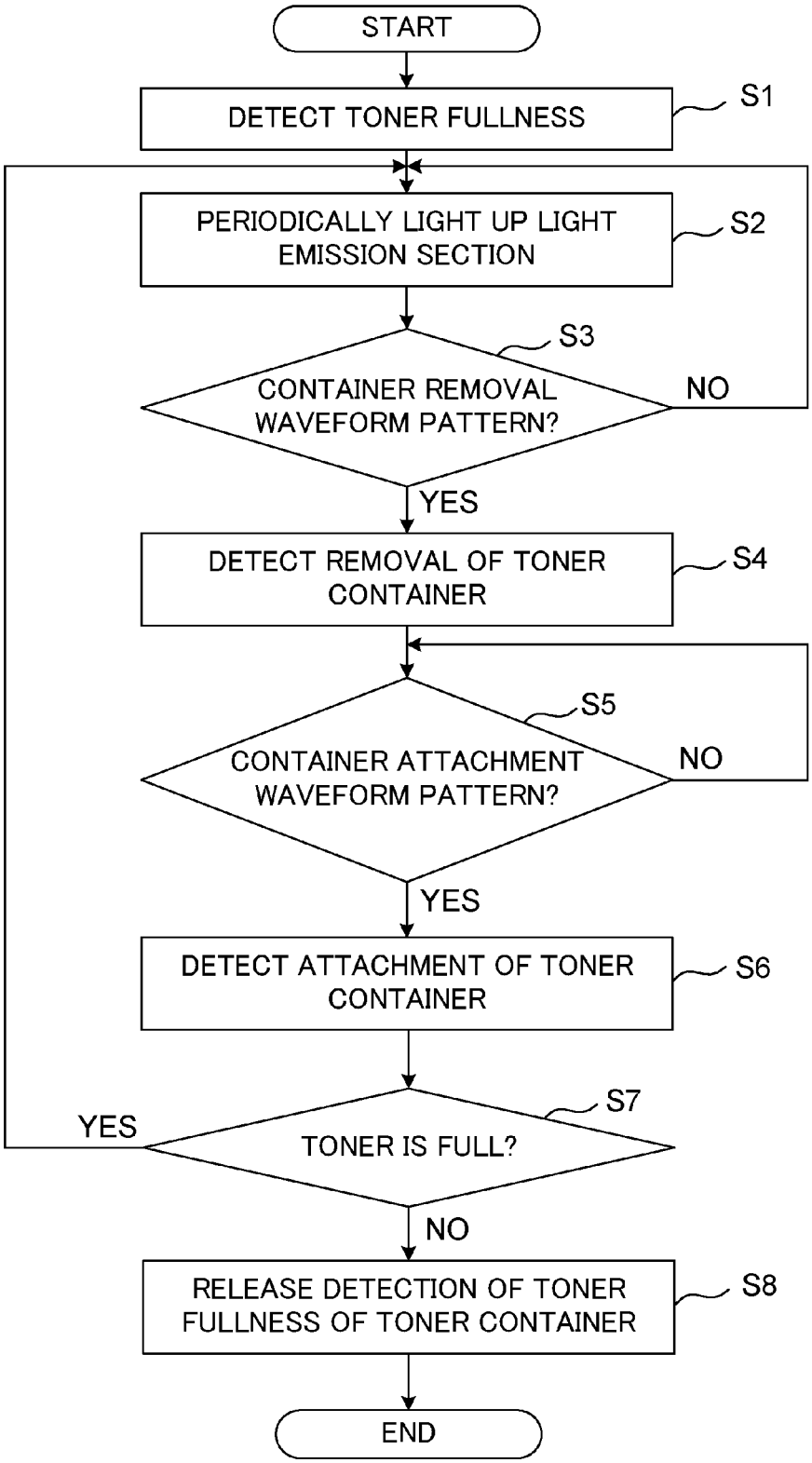
FIG. 10 is a flowchart of detection of toner container attachment and detachment in the image forming apparatus.

Next, processing of detecting the attachment and detachment of the toner container 12 in the image forming apparatus 1 will be described. FIG. 10 is a flowchart of the detection of the attachment and detachment of the toner container 12 in the image forming apparatus 1.

Upon detection of toner fullness based on the signal of the optical sensor 19 by the control section 101 as a result of accumulation of the toner in the toner container 12 (S1), the control section 101, for the purpose of detecting the removal of the toner container 12, controls the light emission section 19A of the optical sensor 19 to periodically light up the light emission section 19A (pulse lighting) (S2). The reason why the light emission section 19A is lit up not continuously but periodically in this manner is for extension of a life of the light emission section 19A.

A cycle in which the light emission section 19A is lit up is desirably sufficiently shorter than time for which the light of the optical sensor 19 is transmitted through the slit 20C and the slit 20D as a result of the sliding of the shutter 20. This is for discrimination between the waveform patterns of the light transmitted through the slit 20C and the slit 20D which patterns appear in the signal of the optical sensor 19 and the pulse lighting of the light emission section 19A, thereby preventing erroneous detection of the attachment and detachment of the toner container 12.

The control section 101 returns to step S2 while detecting, in the signal of the optical sensor 19, none of the aforementioned waveform patterns indicating time of removal of the toner container 12 (NO in S3), and upon detection of this waveform pattern (YES in S3), detects that the toner container 12 has been removed (S4).

Then the control section 101 waits until detecting, in the signal of the optical sensor 19, any of the aforementioned waveform patterns indicating time of attachment of the toner container 12 (NO in S5), and upon detection of this waveform pattern (YES in S5), detects that the toner container 12 has been attached (S6).

Next, the control section 101, based on the signal of the optical sensor 19, judges whether or not the toner in the attached toner container 12 is full, and returns to step S2 if the toner is full (YES in S7). In this case, the control section 101 may display, at the display section 473 (FIGS. 1 and 2), a message urging replacement of the toner container 12.

On the other hand, if the toner is not full (NO in S7), the control section 101 releases the detection of the toner fullness of the toner container 12 (S8). The reason why the detection of the toner fullness is performed after the detection of the attachment of the toner container 12 in this manner is because a new toner container 12 is not necessarily attached as in a case where the detached toner container 12 is attached again. To support such a situation, before releasing the detection of the toner fullness of the toner container 12, the detection of the toner fullness of the attached toner container 12 is performed.

As described above, according to this embodiment, by using the optical sensor 19 for detecting the toner fullness of the toner container 12, the attachment and detachment of the toner container 12 can be detected without increasing the threshold value for detecting the toner fullness of the toner container 12. As a result, a threshold value of the signal of the optical sensor 19 for releasing the toner fullness detection does not have to be set lower than the threshold value for the fullness detection, which can increase the amount of toner at time of the fullness detection.

For example, in case of another technology in which a mechanism of cover opening and closing detection is omitted, and in place of this mechanism, a mechanism of detecting the toner fullness of the toner container is used to detect the attachment and detachment of the toner container, and this is treated as a trigger for releasing the detection of the toner fullness of the toner container, the detection of the attachment and detachment of the toner container is performed by using light blockage by the shutter opening and closing the toner exhaust port of the cleaning device which discharges the toner towards the toner container. In this case, for the purpose of judging whether the waster toner is full or the light is blocked by the shutter, it is required to make discrimination between an output of an optical sensor signal (signal outputted upon the light blockage by the shutter) for releasing the waster toner fullness detection and an output of an optical sensor signal indicating the toner fullness detection. For example, an output value of the optical sensor signal for releasing the toner fullness detection needs to be made lower than an output value of the optical sensor signal indicating the toner fullness detection. Specifically, the threshold value of the optical sensor signal for releasing the toner fullness detection needs to be set lower than the threshold value of the optical sensor signal indicating the toner fullness detection. To this end, it is inevitable to set, high, a threshold value used for judging the optical sensor signal indicating the toner fullness detection. To accurately determine whether the signal is the optical sensor signal for releasing the toner fullness detection or the optical sensor signal indicating the toner fullness detection, the threshold value used for judging the optical sensor signal indicating the toner fullness detection needs to be set even higher so as to provide a clear difference from the output value of the optical sensor signal for releasing the toner fullness detection. However, the higher the threshold value is set, the more the amount of toner at time of the fullness detection decreases.

On the contrary, according to each of the aforementioned embodiments of this disclosure, without needs of judging whether the signal is the optical sensor signal for releasing the toner fullness detection, that is, the signal outputted upon the light blockage by the shutter 20 or the optical sensor signal indicating the toner fullness detection, the attachment and detachment of the toner container 12 can be detected, which therefore eliminates the needs of setting, high, the threshold value used for judging the optical sensor signal indicating the detection of the toner fullness of the toner container 12. Specifically, in each of the aforementioned embodiments of this disclosure, there are no needs of providing a difference between the output of the optical sensor signal for releasing the toner fullness detection and the output of the optical sensor signal indicating the detection of the toner fullness of the toner container 12, so that the threshold value used for judging the optical sensor signal indicating the detection of the toner fullness of the toner container 12 can be set even lower. Thus, the amount of toner stored in the toner container 12 can be increased, which can improve a working ratio of the image forming apparatus 1.

The embodiments of this disclosure have been described above, but this disclosure is not limited to the configuration of the embodiments described above and thus various modifications can be made thereto. For example, three or more slits may be formed at the side surface member 20B of the shutter 20. Moreover, for example, the embodiments above have been described, referring to the printer as one embodiment of the image forming apparatus according to this disclosure, but this is just one example, and a different image forming apparatus such as, for example, a copier, a facsimile device, or a composite machine may be used.

Moreover, the configuration shown by the embodiments described above with reference to FIGS. 1 to 10 is just one embodiment of this disclosure, and this disclosure is not limited to this configuration.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image carrier on a surface of which a toner image is developed;

a transfer device transferring the toner image from the image carrier onto paper;

a cleaning device removing a toner remaining on the surface of the image carrier and discharging the toner from a toner exhaust port;

a toner container of a detachable type having an opening part formed of a transparent member, receiving, through the opening part, the toner discharged from the cleaning device, and storing the toner therein;

an optical sensor having a light emission section and a light reception section arranged at position sandwiching the opening part of the toner container from both sides when the toner container is attached;

a shutter sliding in conjunction with the attachment and detachment of the toner container, the shutter having a top surface member opening and closing the toner exhaust port of the cleaning device and a side surface member transmitting and blocking light of the optical sensor; and a control section, based on a signal outputted from the optical sensor, performing detection of fullness of the toner stored in the toner container and detection of the attachment and detachment of the toner container, wherein a slit extending in a direction orthogonal to a sliding direction of the shutter is formed at the side surface member of the shutter, and the control section performs the detection of the attachment and detachment of the toner container based on a waveform pattern of light transmitted through the slits which pattern appears in the signal of the optical sensor.

2. The image forming apparatus according to claim 1, wherein the control section judges that the toner container has been detached based on a duration of time between:

a time point at which a change occurs from a light reception amount of light received by the light reception section from the light emission section after transmitted through the opening part in a state in which an optical path from the light emission section to the light reception section is interfered or nearly blocked by the toner in the opening part to a light reception amount of light received by the light reception section in a state in which the optical path is blocked by the side surface member of the shutter; and a time point at which a change to a light reception amount of light received by the light reception section directly from the light emission section through the slit without transmitted through the opening part occurs.

3. The image forming apparatus according to claim 1, wherein the control section judges that the toner container has been fitted based on a duration of time between:

a time point at which a change occurs from a light reception amount of light received by the light reception section directly from the light emission section through the slit without transmitted through the opening part to a light reception amount of light received by the light reception section in a state in which the optical path is blocked by the side surface member of the shutter; and a time point at which a change to a light reception amount of light received by the light reception section from the light emission section after transmitted through the opening part in a state in which no toner is in the opening part occurs.

4. The image forming apparatus according to claim 1, wherein the shutter is biased in a direction in which the toner container is detached from a main body of the image forming apparatus, in a state in which the toner container is detached from the main body, closes the toner exhaust port of the cleaning device provided at position opposing the opening part of the toner container, and upon fitting of the toner container to the main body, receives pressure by the toner container moving in a direction in which the toner container is fitted to the main body, makes sliding movement against a force of the biasing in the direction in which the toner container is fitted, and opens the toner exhaust port towards the opening part of the toner container.

5. The image forming apparatus according to claim 4, wherein at the side surface member of the shutter, a narrow slit and a wide slit orthogonal to a direction in which the shutter makes the sliding movement are formed alongside in order just mentioned in a direction in which the toner container is detached from the main body of the image forming apparatus, and the control section, upon prior appearance of a waveform which indicates that the light reception section has received the light emitted from the light emission section and which corresponds to the narrow slit, judges that the toner container has been detached, and upon prior appearance of a waveform corresponding to the wide slit, judges that the toner container has been fitted.

* * * * *